United States Patent [19]

Bryson et al.

[11] Patent Number: 4,871,074

[45] Date of Patent: Oct. 3, 1989

[54] HAIR APPLIANCE ORGANIZER

[76] Inventors: Ronald D. Bryson; Linda L. Bryson, both of 19 Hillcrest Rd., Enola, Pa. 17025

[21] Appl. No.: 278,482

[22] Filed: Dec. 1, 1988

[51] Int. Cl.[4] ..... A47F 7/00

[52] U.S. Cl. ..... 211/13; 211/70.6

[58] Field of Search ..... 211/13, 70.6, 60.1, 211/69, 74, 87; 206/349, 361, 553

[56] References Cited

U.S. PATENT DOCUMENTS

| | | | |
|---|---|---|---|
| D. 293,651 | 1/1988 | Aeschliman . | |
| 2,371,433 | 3/1945 | Davis | 211/70.6 |
| 2,974,804 | 3/1961 | Maro | 211/70.6 |
| 3,431,041 | 3/1969 | Fontlladosa | 211/60.1 X |
| 3,456,806 | 7/1969 | Borston | 211/60.1 |
| 4,190,166 | 2/1980 | Allsop | 211/60.1 |
| 4,219,178 | 8/1980 | Assion . | |
| 4,308,878 | 1/1982 | Silva . | |
| 4,696,447 | 9/1987 | Strecher . | |
| 4,746,090 | 5/1988 | Hamilton . | |

FOREIGN PATENT DOCUMENTS

| | | | |
|---|---|---|---|
| 2549554 | 5/1977 | Fed. Rep. of Germany | 211/70.6 |
| 1543383 | 4/1979 | United Kingdom | 211/70.6 |

*Primary Examiner*—Sarah A. Lechok
*Attorney, Agent, or Firm*—Jerry T. Kearns

[57] ABSTRACT

A hair appliance organizer is in the form of a rack having first and second spaced parallel rectangular support surfaces connected along back longitudinal edges by a transverse wall, forming an open rectangular channel. A plurality of pairs of spaced aligned circular apertures extend through the first and second support surfaces. A plurality of slots extend from a front edge of the first and second support surfaces and intersect the circular apertures. In use, hair appliances such as blow dryers and curling irons are inserted through the aligned apertures and stored when not in use. In a second embodiment of the invention, frusto conical inserts are received in the circular apertures and are formed from metal to dissipate and distribute heat from the inserted hair appliance. The inserts may be formed of various different diameters for use with different sized hair appliances. Each insert has a radially extending flange overlying the associated support surface and has a slotted side wall in alignment with the associated slot of the receiving aperture. Smaller diameter inserts may be surrounded by an O-ring to provide frictional engagement with the receiving aperture.

8 Claims, 3 Drawing Sheets

HAIR APPLIANCE ORGANIZER

BACKGROUND OF THE INVENTION

1. Field of the Invention

The present invention relates to hair appliance organizers, and more particularly pertains to a rack specifically designed to store hair appliances such as curling irons and blow dryers. Such appliances include electrical cords which frequently become tangled and disarrayed. Additionally, the devices are electrically heated and care must be taken as to their placement during heating for proper safety. Presently, such appliances are often stored utilizing the attached electrical cord as a support. This places undue strain on the cord and creates an electrical shock hazard. Additionally, such hair appliances are frequently laid upon a flat counter surface and as a result, their electrical cords become entangled. In order to overcome these problems, the present invention provides a rack for supporting and neatly organizing a plurality of hair appliances.

2. Description of the Prior Art

Various types of article storing racks are known in the prior art. A typical example of such a rack is to be found in U.S. Pat. No. 4,219,178, which issued to N. Assion on Aug. 26, 1980. This patent discloses a holder for an electrical appliance such as a hair dryer adapted for mounting on a wall surface and having a circular slotted aperture for receiving the handle of the appliance and further including selectively releasable detenting means for locking the appliance to the holder. U.S. Pat. No. 4,308,878, which issued to W. Silva on Jan. 5, 1982, discloses a curling iron holder formed of molded plastic and defining a central cavity dimensioned to receive the heated portion of a conventional curling iron. The diameter of the cavity is greater than that of the heated portion of the curling iron so that there is an annular space between the outer surface of the curling iron and the inner surface of the cavity. A plurality of centering guides hold the curling iron centrally in the cavity to maintain the annular space. U.S. Pat. No. Des. 293,651, which issued to W. Aeschliman on Jan. 12, 1988, discloses a lamp tube holder which includes a plurality of cylindrical holders provided with central longitudinally extending cylindrical sockets. U.S. Pat. No. 4,696,447, which issued to D. Strecker on Sept. 29, 1987, discloses a blow dryer holding device which includes a circular slotted holding portion pivotally mounted to a suction cup mounted retaining bracket. U.S. Pat. No. 4,746,090, which issued to R. Hamilton on May 24, 1988, discloses an adjustable holder for a hand held hair dryer which allows rotation and vertical movement of the hair dryer according to the needs of the user. The device comprises a holder member having an open sided receiving hole in one extremity dimensioned to receive a handle of a hair dryer and an attachment bracket on an opposite extremity. A wall mounted base is permanently attached to a wall and is formed with a vertically extending row of spaced apertures to allow adjustable vertical positioning of the holding member.

While the above mentioned devices are suited for their intended usage, none of these devices disclose a hair appliance organizer capable of storing a plurality of differently dimensioned blow dryers and curling irons. Additionally, none of the aforesaid devices disclose a hair appliance organizer rack including first and second spaced parallel rectangular support surfaces connected by a transverse wall forming an open rectangular channel and provided with a plurality of pairs of spaced aligned circular apertures for receiving various hair appliances. Additionally, none of the aforesaid devices disclose the use of selectively insertable frusto conical inserts of various dimensions for allowing storage of differently sized hair appliances. Inasmuch as the art is relatively crowded with respect to these various types of hair appliance organizers, it can be appreciated that there is a continuing need for and interest in improvements to such hair appliance organizers, and in this respect, the present invention addresses this need and interest.

SUMMARY OF THE INVENTION

In view of the foregoing disadvantages inherent in the known types of hair appliance organizers now present in the prior art, the present invention provides an improved hair appliance organizer. As such, the general purpose of the present invention, which will be described subsequently in greater detail, is to provide a new and improved hair appliance organizer which has all the advantages of the prior art hair appliance organizers and none of the disadvantages.

To attain this, representative embodiments of the concepts of the present invention are illustrated in the drawings and make use of a rack having first and second spaced parallel rectangular support surfaces connected along back longitudinal edges by a transverse wall, forming an open rectangular channel. A plurality of pairs of spaced aligned circular apertures extend through the first and second support surfaces. A plurality of slots extend from a front edge of the first and second support surfaces and intersect the circular apertures. In use, hair appliances such as blow dryers and curling irons are inserted through the aligned apertures and stored when not in use. In a second embodiment of the invention, frusto conical inserts are received in the circular apertures and are formed from metal to dissipate and distribute heat from the inserted hair appliance. The inserts may be formed of various different diameters for use with different sized hair appliances. Each insert has a radially extending flange overlying the associated support surface and has a slotted side wall in alignment with the associated slot of the receiving aperture. Smaller diameter inserts may be surrounded by an O-ring to provide frictional engagement with the receiving aperture.

There has thus been outlined, rather broadly, the more important features of he invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair appliance organizer which has all the advantages of the prior art hair appliance organizers and none of the disadvantages.

It is another object of the present invention to provide a new and improved hair appliance organizer which may be easily and efficiently manufactured and marketed.

It is a further object of the present invention to provide a new and improved hair appliance organizer which is of a durable and reliable construction.

An even further object of the present invention is to provide a new and improved hair appliance organizer which is susceptible of a low cost of manufacture with regard to both materials and labor, and which accordingly is then susceptible of low prices of sale to the consuming public, thereby making such hair appliance organizers economically available to the buying public.

Still yet another object of the present invention is to provide a new and improved hair appliance organizer which provides in the apparatuses and methods of the prior art some of the advantages thereof, while simultaneously overcoming some of the disadvantages normally associated therewith.

Still another object of the present invention is to provide a new and improved hair appliance organizer for holding and organizing a plurality of blow dryers and curling irons in a safe manner.

Yet another object of the present invention is to provide a new and improved hair appliance organizer for storing a plurality of electrical hair appliances without allowing entanglement of their electrical cord.

Even still another object of the present invention is to provide a new and improved hair appliance organizer which utilizes selectively insertable inserts to allow storage of various different sizes of hair appliances.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
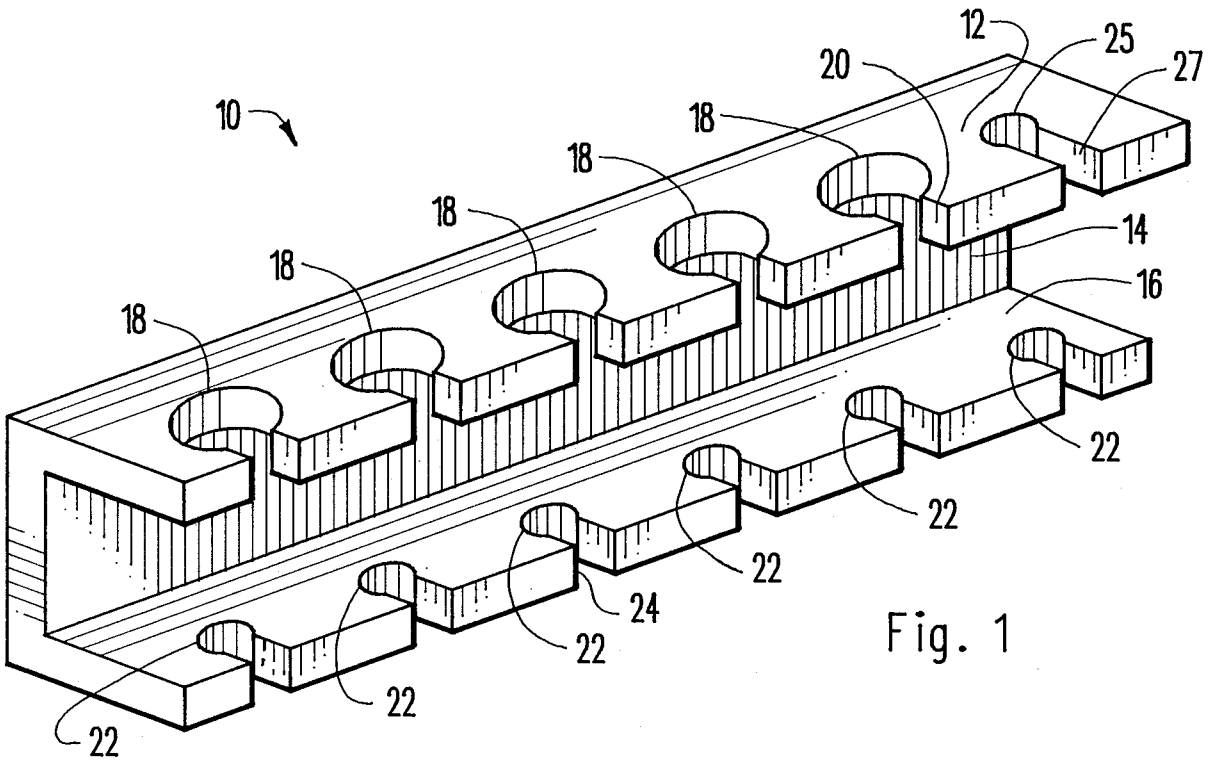
FIG. 1 is a perspective view of the hair appliance organizer according to the first embodiment of the present invention.

With reference now to the drawings, and in particular to FIG. 1 thereof, a new and improved hair appliance organizer embodying the principles and concepts of the present invention and generally designated by the reference numeral 10 will be described.

More specifically, it will be noted that the first embodiment 10 of the invention includes first 12 and second 16 spaced parallel rectangular support surfaces connected along back longitudinal edges by a transverse rectangular wall 14, forming an open rectangular channel. A plurality of pairs of vertically spaced aligned circular apertures 18 and 22 extend through the first 12 and second 16 support surfaces. A plurality of slots 20 and 24 extend from a front edge of the first 12 and second 16 support surfaces and intersect the circular apertures 18 and 22. The support surfaces 12 and 16 are preferably each about 3 and ½ inches wide and 18 inches long. The five larger diameter circular apertures 18 formed in the first or upper supporting surface 12 are preferably about 1 and ¾ inches in diameter and have a ½ inch wide slot 20. The smaller diameter holes 22 in the second or bottom support surface 16 preferably have a diameter of about ¾ inches. The smaller diameter aperture 25 in the upper support surface 12 is also preferably about ¾ inch in diameter. In use, the various hair appliances are inserted through the aligned apertures 18 and 22, in a vertical orientation. The aligned slotted portions 20 and 24 allow the attached electrical cord to be inserted. Thus, the electrical cord of the device may remain in engagement with an electrical outlet, and is protected from entangled with electrical cords of adjacent appliances. The first 12 and second 16 support surfaces are spaced vertically apart approximately 4 and ½ inches. The hair appliance organizing rack is designed to be secured to a vertical supporting surface such as a wall, by conventional means such as through the use of threaded fasteners or for example, by suction cups or adhesively.

Figure 2:
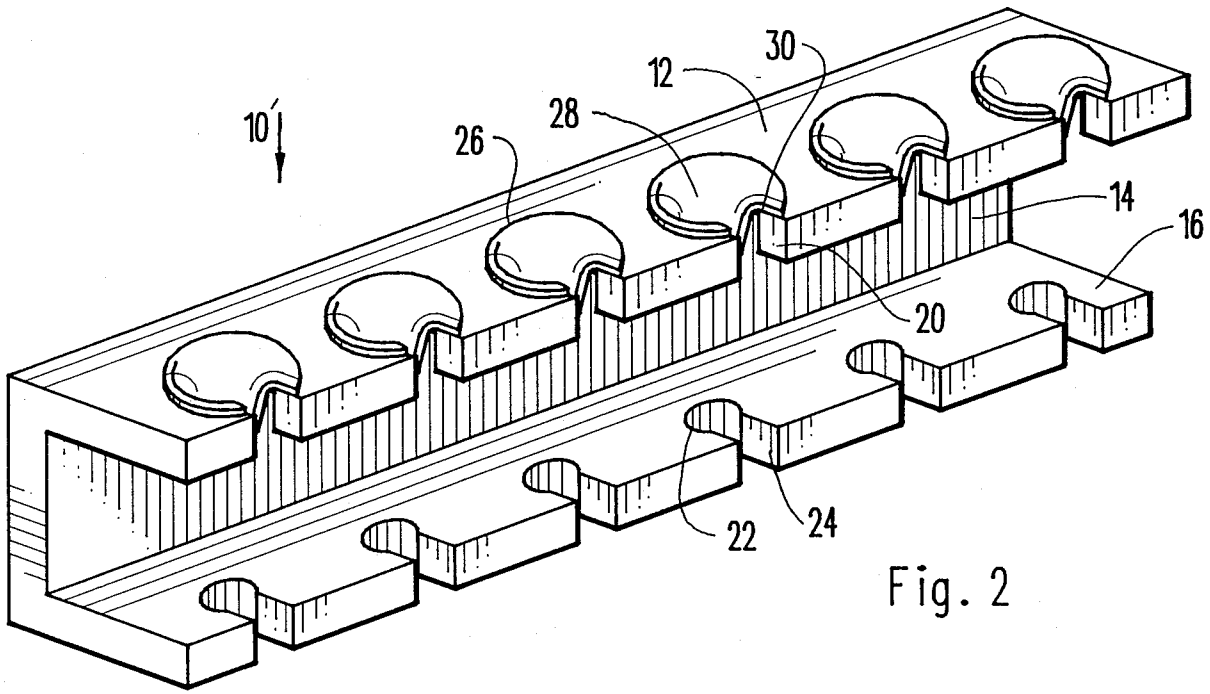
FIG. 2 is a perspective view of the hair appliance organizer according to a second embodiment of the present invention.

In FIG. 2, a second embodiment of a hair appliance organizer 10' is illustrated. The basic construction of the device is identical to that described with reference to FIG. 1, with the exception that a plurality of frusto conical inserts 28 are received within the circular apertures formed through the first or upper support surface 12. Each of the inserts 28 has a radially extending flange 26 which overlies the upper surface of the support surface 12. A slotted side wall portion of the frusto conical insert 28 is in alignment with the slotted portion 20 of the support surface 12. The inserts 28 are preferably formed from metal, while the supporting surfaces 12, 16 and the transverse wall 14 are preferably formed from a hard wood. The metal inserts 28 perform two functions. First of all, they are utilized to adapt the hair appliance organizer rack for use with various hair appliances of different diameters. Secondly, the metal inserts 28 serve to absorb and disperse latent heat from hair appliances such as curling irons and blow dryers.

Figure 3:
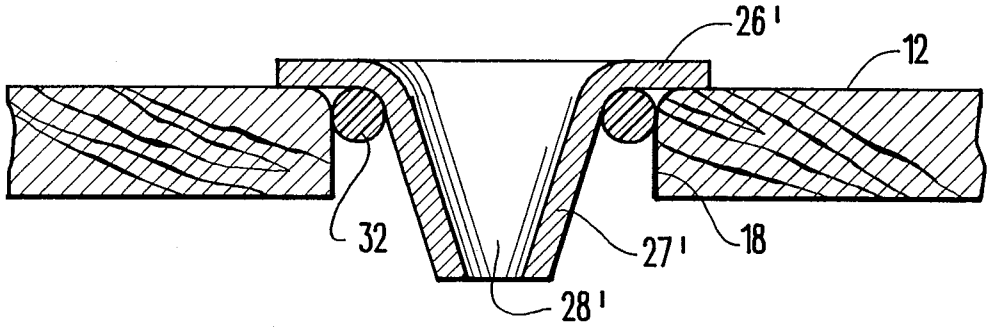
FIG. 3 is a partial cross sectional view, illustrating a frusto conical insert received in the hair appliance organizer.

FIG. 3 provides a partial transverse cross sectional view which illustrates the frusto conical downward tapering of the insert 28'. The insert 28' is identically constructed as the inserts 28 illustrated in FIG. 2, but is of a reduced diameter to accommodate smaller hair appliances. To adapt the smaller sized insert 28' for insertion within the aperture 18, the radially extending flange 26' has a greater radial extent with respect to the maximum diameter upper portion of the side wall 27' of the insert 28'. An O-ring 32 surrounds the maximum diameter portion of the insert 28' and is in frictional engagement with the side walls of the circular aperture 18 in the support surface 12.

Figure 4:
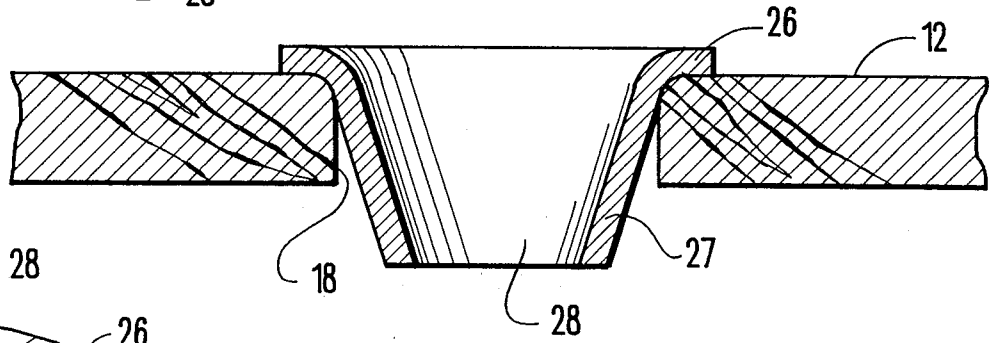
FIG. 4 is a partial cross sectional detail view, illustrating a larger sized insert received in the hair appliance organizer.

In FIG. 4, the standard sized insert 28 is illustrated received within the circular aperture 18 of the support surface 12.

Figure 5:
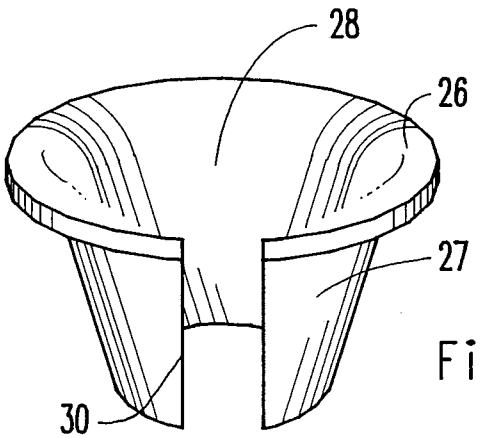
FIG. 5 is a perspective view illustrating a frusto conical insert.

FIG. 5 provides a perspective view which illustrates the frusto conical hollow insert 28. As illustrated, the insert 28 has a conically tapering side wall 27, with a maximum diameter portion disposed adjacent the radially extending flange 26. A longitudinal slot 30 is provided in the side wall 27 and is dimensioned for registry with the notches or slots 20 (FIG. 1) formed in the supporting surface 12.

As may now be understood, the device of the present invention provides an extremely adaptable rack which may be utilized to store a wide variety of differently dimensioned hair appliances such as curling irons and blow dryers in a safe and organized manner.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair appliance organizer rack for holding hair appliances, comprising:

first and second spaced parallel rectangular support surfaces;

a transverse wall connecting back longitudinal edges of said first and second support surfaces, forming an open rectangular channel;

a plurality of pairs of spaced aligned circular apertures extending through said first and second support surfaces;

a plurality of slots extending from a front edge of said first and second support surfaces and intersecting said circular apertures;

a plurality of frusto conical hollow inserts in said circular apertures;

each of said inserts having a slotted side wall portion in alignment with said slots formed in said first and second supporting surfaces;

each of said inserts having a radially extending flange overlying one of said first and second supporting surfaces; and at least one of said inserts having a maximum diameter substantially smaller than the diameter of the associated receiving aperture, and is surrounded by an O-ring.

2. The hair appliance organizer of claim 1, wherein said first and second support surfaces in said transverse wall are formed from wood and said inserts are formed from metal.

3. A hair appliance organizer rack for holding appliances, comprising:

first and second spaced parallel rectangular support surfaces;

a transverse wall connecting back longitudinal edges of said first and second support surfaces, forming an open rectangular channel;

a plurality of pairs of spaced aligned circular apertures extending through said first and second support surfaces;

a plurality of slots extending from a front edge of said first and second support surfaces and intersecting said circular apertures;

and a plurality of frusto conical hollow inserts in said circular apertures, said frusto conical inserts each having a slotted side wall portion in alignment with said slots formed in said first and second supporting surfaces.

4. The hair appliance organizer of claim 3, wherein said circular apertures in said second support surface are smaller in diameter than the circular apertures in said first support surface.

5. The hair appliance organizer of claim 3, wherein each of said frusto conical inserts have a radially extending flange overlying one of said first and second supporting surfaces.

6. A hair appliance organizer rack for holding appliances, comprising:

first and second spaced parallel rectangular support surfaces;

a transverse wall connecting back longitudinal edges of said first and second support surfaces, forming an open rectangular channel;

a plurality of pairs of spaced aligned circular apertures extending through said first and second support surfaces;

a plurality of slots extending from a front edge of said first and second support surfaces and intersecting said circular apertures;

a plurality of frusto conical hollow inserts in said circular apertures; and at least one of said frusto conical inserts having a maximum diameter substantially smaller than the diameter of the associated receiving aperture and surrounded by an O-ring.

7. The hair appliance organizer of claim 6, wherein said circular apertures in said second support surface are smaller in diameter than the circular apertures in said first support surface.

8. The hair appliance organizer of claim 6, wherein each of said frusto conical inserts have a radially extending flange overlying one of said first and second supporting surfaces.

* * * * *